US005189850A

United States Patent [19]

Felton

[11] Patent Number: 5,189,850

[45] Date of Patent: Mar. 2, 1993

[54] SYSTEM FOR MOUNTING A WALL STANDARD

[75] Inventor: J. Reed Felton, Milwaukee, Wis.

[73] Assignee: T. J. Hale Company, Menomonee Falls, Wis.

[21] Appl. No.: 830,059

[22] Filed: Feb. 3, 1992

[51] Int. Cl.[5] ..... A47G 29/02

[52] U.S. Cl. ..... 52/36.4; 52/731.8; 248/243

[58] Field of Search ..... 52/36, 729, 282, 581, 52/582, 731; 248/241, 243; 211/103, 104, 87, 182

[56] References Cited

U.S. PATENT DOCUMENTS

| | | | |
|---|---|---|---|
| 3,492,766 | 2/1970 | Andrews | 52/36 |
| 3,509,669 | 5/1974 | Plemeng | 52/36 |
| 3,648,419 | 3/1972 | Marks | 52/36 |
| 3,925,939 | 12/1975 | Costruba . | |
| 4,441,300 | 4/1984 | Varon et al. . | |

*Primary Examiner*—David A. Scherbel
*Assistant Examiner*—Creighton Smith
*Attorney, Agent, or Firm*—Jansson & Shupe, Ltd.

[57] ABSTRACT

The improved system is used for mounting a "wall standard," i.e., an elongate, slotted strip to which shelf support brackets are attached. The standard is in a wall-like display structure of the type having plural support studs. The improved system includes a box-like "filler" or spacer mounted between the studs. The spacer has at least one exposed edge used to attach a retention assembly for holding panels to the wall "skeleton." The assembly includes a pair of upright members which are commonly-shaped but mounted in inverted "mirror image" relationship one to the other. Such upright members each have several spaced tabs, each of which is "interposed" between tabs of the other upright member. Tabs of both upright members are attached to the first edge for panel support. Using commonly-shaped, inverted-mounted upright members increases installation flexibility and reduces parts inventory. Certain system features accommodate wall panels of differing thickness and mount panels for quick attachment and removal. The system lends itself well to easy adjustment of standard location and off-site fabrication.

19 Claims, 7 Drawing Sheets

SYSTEM FOR MOUNTING A WALL STANDARD

FIELD OF THE INVENTION

This invention is related generally to interior building walls and, more particularly, to such walls constructed to display products thereon.

BACKGROUND OF THE INVENTION

Department and other types of retail stores frequently display products on perimeter or interior walls specially configured for the purpose. Such products may be hung from hooks or brackets or displayed upon shelves which, themselves, are supported by brackets projecting from the wall. Often, such specially-configured walls are provided and installed by contractors or by contracting manufacturers on a bid basis.

Special walls constructed for the particular purpose of product display are said (in the vernacular of the industry) to include "wall standards," "key stripping" or "in-line standards." As used in the industry (and as used herein) the term "standard" is a noun referring to a vertically-oriented, relatively long, narrow strip, usually metal, which has spaced elongate slots along its length. Ends of support hooks or brackets are inserted into such slots to hold products or shelves.

Sometimes the wall is constructed so that the standard is concealed except to close inspection; in other wall arrangements, the standard is surface mounted. The former type is most often used commercially; the latter type is often used in private residences to make book shelves and the like. With surface mounted standards, the slotted standard is merely an "add-on" to an existing conventional wall. Of course, a benefit of wall standards is that hooks and brackets can be placed at any of a number of locations along the standard—and can just as easily be re-located as displays of products are modified to meet changing marketing needs.

Design, manufacture and installation of existing wall standard mounting systems, especially those used commercially in department stores and the like, are attended by frequently-occurring obstacles in the manufacture and sale of "wall standard" wall display systems. These systems are very frequently sold as part of a bid project.

One obstacle is that some known systems require an existing wall for system mounting. One such system, offered by Garcy Corporation, is described below and requires that furring strips be applied to a wall before the display wall system is installed. To the extent any such system requires a wall, it loses an enormous amount of flexibility in wall placement. To put it another way, such wall display systems must be installed according to the dictates of the existing building rather than in locations most effective from a display standpoint.

U.S. Pat. No. 3,848,364 (Costruba) shows a shelving support structure using sheet metal studs in a spaced, back-to-back arrangement. The studs are spaced apart by interlock members placed between the studs and each interlock member has a pair of oppositely-extending flange portions overlapping a stud flange. The structure uses spot welding and "groups" of screws to construct the standard and mount panels thereon. Such patent also illustrates how a free standing wall is constructed.

U.S. Pat. No. 3,193,885 (Gartner et al.) shows a quickly-erectable wall with a floating wood stud. Studs are made up in advance to have several vertically-spaced clips inset into the stud by a dimension such that the laterally extending tongues of the clips are spaced away from the stud somewhat. Companion panels are grooved to accept the tongues as the studs are slipped into place.

U.S. Pat. No. 3,305,981 (Biggs et al.) shows a wall structure using what the patent calls stud assembly units. Each unit has at least one heavy gauge slotted channel iron (that which holds the shelf bracket) and light gauge stud retaining clips. The retaining clips are separated by a "Z" shaped vertical spacer. Conventional sheet metal studs are slipped into the assembly unit in a spaced back-to-back relationship and wall panels are then attached by screws.

U.S. Pat. No. 4,588,156 (Doke et al.) shows a bracket support structure in which each support has oppositely extending flanges parallel to the finished wall. Each such flange attaches to the flange of a sheet metal stud. Each support also has a pair of outward extending blades against which vertical edges of the wall board sections abut in the finished wall. The blades are of fixed dimension made to "match" wall board of a particular thickness.

U.S. Pat. No. 4,535,525 (Varon et al.) shows a wall system which uses an adaptor captured between two sheet metal studs. Each adaptor has two dissimilar members which fit together with one another in tongue-and-groove fashion. The adaptor retains a slotted bar and when fully assembled and "shaped" by the roller mandrel apparatus, the standard is said to be permanently clamped in place.

U.S. Pat. No. 4,688,750 (Teague et al.) shows a relatively complex component mounting system using studs shaped something like an I-beam. The stud flanges support the wall panels. Panels are clamped in place by retainers and after the panels are so secured, screw-retained component mounting brackets are installed.

U.S. Pat. No. 2,040,385 (Kellogg) shows a wall assembly using pin-and-slot mounting. Slots are cut into flanges of special studs, thereby negating the possibility of using standard sheet metal studs. U.S. Pat. No. 4,918,879 (Bodurow et al.) shows a wall mounting system using a one-piece, T-shaped standard. The standard does not permit separate adjustment of its position relative to the wall panels. U.S. Pat. No. 3,859,765 (Nelsson) shows mounting of wall panels using Velcro® strips.

Literature by Garcy Corporation describes three systems, namely, Image Plus, Adapt-A-Stud and Garcy/Stud. The first contemplates installation on furring strips mounted on an existing wall. Exterior exposed panels are retained by a rear mounted angle bracket and spring catch. The Adapt-A-Stud system uses slotted adapters mounted to a pair of spaced sheet metal studs. The slotted standard is secured with two screws through a housing and into anchor clips. The Garcy/-Stud system combines the structure of two back-to-back sheet metal studs with a slotted standard. The standard is secured as in the Adapt-A-Stud system. Gypsum wall board can be mounted on both sides. It is unclear on how the wall board is secured, but it is believed to be held by fitting it into top and bottom channels a with the Image Plus system.

Another obstacle is that, characteristically, known wall standard systems are very labor intensive and require a good deal of on-site "cut and fit" by skilled, well-compensated persons. To state it differently, such systems do not lend themselves well to partial, more rapid wall fabrication at a remote manufacturing site where proper tools, jigs and the like are available.

Still another disadvantage of some known wall standard systems is that they fail to take full advantage of "parts commonality." That is, each system component is configured for a particular use in a particular part of the system and cannot be used "double duty" in any other way.

The inventive system, summarized and described in detail below, resolves many of these disadvantages in a unique way.

OBJECTS OF THE INVENTION

It is an object of this invention to provide an improved wall standard mounting system overcoming some of the problems and shortcomings of devices of the prior art.

Another object of this invention is to provide an improved wall standard mounting system which takes advantage of parts commonality.

Yet another object of this invention is to provide an improved wall standard mounting system wherein the position of the strip-like standard is readily adjustable at virtually any stage of wall construction.

Another object of this invention is to provide an improved wall standard mounting system useful to erect perimeter or free-standing interior display walls.

Still another object of this invention is to provide an improved wall standard mounting system readily accommodating wall panels of differing thicknesses.

Another object of this invention is to provide an improved wall standard mounting system lending itself to substantial prefabrication at a remote manufacturing site.

Another object of this invention is to provide an improved wall standard mounting system using conventional wall studs, preferably sheet metal studs, in system construction. These and other important objects will be apparent from the following detailed description taken in conjunction with the drawing.

SUMMARY OF THE INVENTION

The improved system is used for mounting a wall standard in a wall-like display structure of the type having plural support studs, e.g., conventional sheet metal studs or 2×4's. The improved system includes a box-like "filler" or spacer of rectangular cross-section. The spacer is mounted between the wider faces of adjacent studs so as to separate them slightly. The spacer has a first attachment edge and, preferably, an opposing second attachment edge.

A first retention assembly attaches to an edge and engages and supports one or more wall panels as described below. The retention assembly includes a pair of commonly-shaped upright members; that is, such upright members are essentially identical to one another. Each upright member includes a web, a plurality of attachment tabs spaced along one edge of the web and a panel retaining lip along its other edge. When mounted in inverted relationship one to the other, each member has at least one tab interposed between a pair of tabs of the other member. In fact, virtually all tabs of each member are interposed between tabs of the other in something of an "interdigitated" relationship. Selected tabs are attached by screws to the edge of the spacer for panel support.

In a highly preferred embodiment, each tab has a width closely similar to that of the strip-like standard "captured" between the upright members in a finished wall. Each upright member includes a web spaced by about a tab width from that of its companion upright member. And each such upright member also has a groove for receiving the standard which is adjustably retained between the grooves by a spring device. Such temporary retention makes it very easy to assure that the display shelves, etc. (mounted on the wall at the conclusion of construction) are level. The wall standards can be lightly "tapped" up or down until a reference line drawn through corresponding locations, e.g., the tops of the first slots, on the standards is level.

The spring device may be fitted to at least one upright member for standard retention. Or it may be fitted to the standard and engage the grooves of the upright members for temporary standard retention when the standard is inserted between the members.

The new system offers enormous flexibility in constructing perimeter and interior wall standard systems where panels of differing thicknesses may be required to be used. For example, the system may include two or more pairs of upright members, each member of each pair having attachment tabs and a retaining lip. A pair of upright members includes tab-to-lip spacing differing from that of another pair of upright members so that the system accommodates panels of differing thicknesses. As will be further appreciated from the detailed description, the tab-to-lip spacing is substantially equal to the width of the web.

In another example, the system may include two or more spacers, each having a face dimension differing from that of at least one other spacer. This feature also accommodates panels of differing thicknesses. Of course, spacers of differing face dimensions and upright members having differing tab-to-lip spacing can be used separately or combined in a single installation.

As will become more apparent from the detailed description, the improved system lends itself to construction of one-sided perimeter walls (where mounting is to an existing wall) and of double-sided, freestanding interior walls. For the latter, the spacer includes a second attachment edge and a second retention assembly having a pair of upright members attached to the second edge for panel support.

Panels of differing thickness are mounted on the respective wall sides by using retention assemblies on one side which have a web width different from that of the assemblies on the other side. Or one may use retention assemblies of substantially identical web width on both wall sides and mount the spacer offset with respect to the flange surfaces of the studs. And of course, both approaches can be used. To recap, the installer can accommodate panels of different thicknesses by using (a) spacers of differing face dimensions, (b) upright members with differing tab-to-lip spacing and/or (c) offset the position of the spacer with respect to the stud flange surfaces.

Ease of initial panel mounting and of wall re-arrangement or removal are important considerations in wall standard systems. In a highly preferred embodiment, the system includes panels mounted to upright members (rather than to studs) by pin-and-groove devices. The upright members support substantial panel weight and the system uses conventional studs. In another version, panels are mounted to upright members by Velcro® strips.

DETAILED DESCRIPTIONS OF THE PREFERRED EMBODIMENTS

Figure 1:
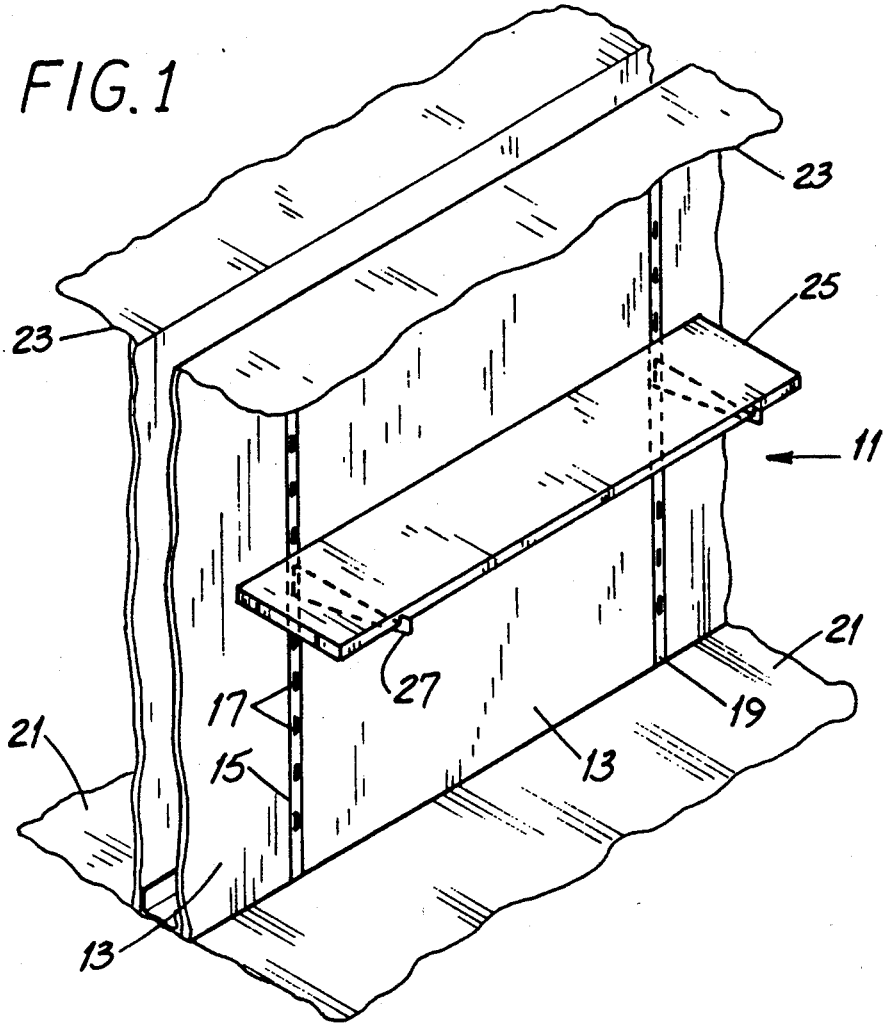
FIG. 1 is a representative perspective view, with parts broken away and other parts in phantom outline, of a "wall standard" type display wall.

Before describing the details of the inventive system 10, readers will find it helpful to refer to FIG. 1 showing how such system 10 is used. The illustrated wall 11 includes outer panels 13, often decorative, seen by individuals viewing displayed products. The wall 11 includes one or more vertical standards 15 with slots 17. In practice, the standard 15 is "inset" somewhat behind the panels 13 and is visible only upon closer inspection. However, the gap 19 between panels 13 is clearly visible and is considered by many to detract from the aesthetics of the display. As described below, the inventive system 10 offers (among other advantages) a way to minimize the width of such gap 19.

The display wall 11 may extend between floor 21 and ceiling 23 as shown or be foreshortened, e.g., to countertop height. The wall 11 may be single-sided and mounted to an existing perimeter wall. Or it may be double sided as shown in dashed outline. Products are displayed on one or more shelves 25 supported by brackets 27 hooked into slots 17. Typically, there are a number of slots 17 along the standard 15 so that the vertical position of the shelf 25 can be selected for most advantageous product display. And only a single bracket 27 or hook can be used to display, for example, purses hung therefrom.

Figure 2:
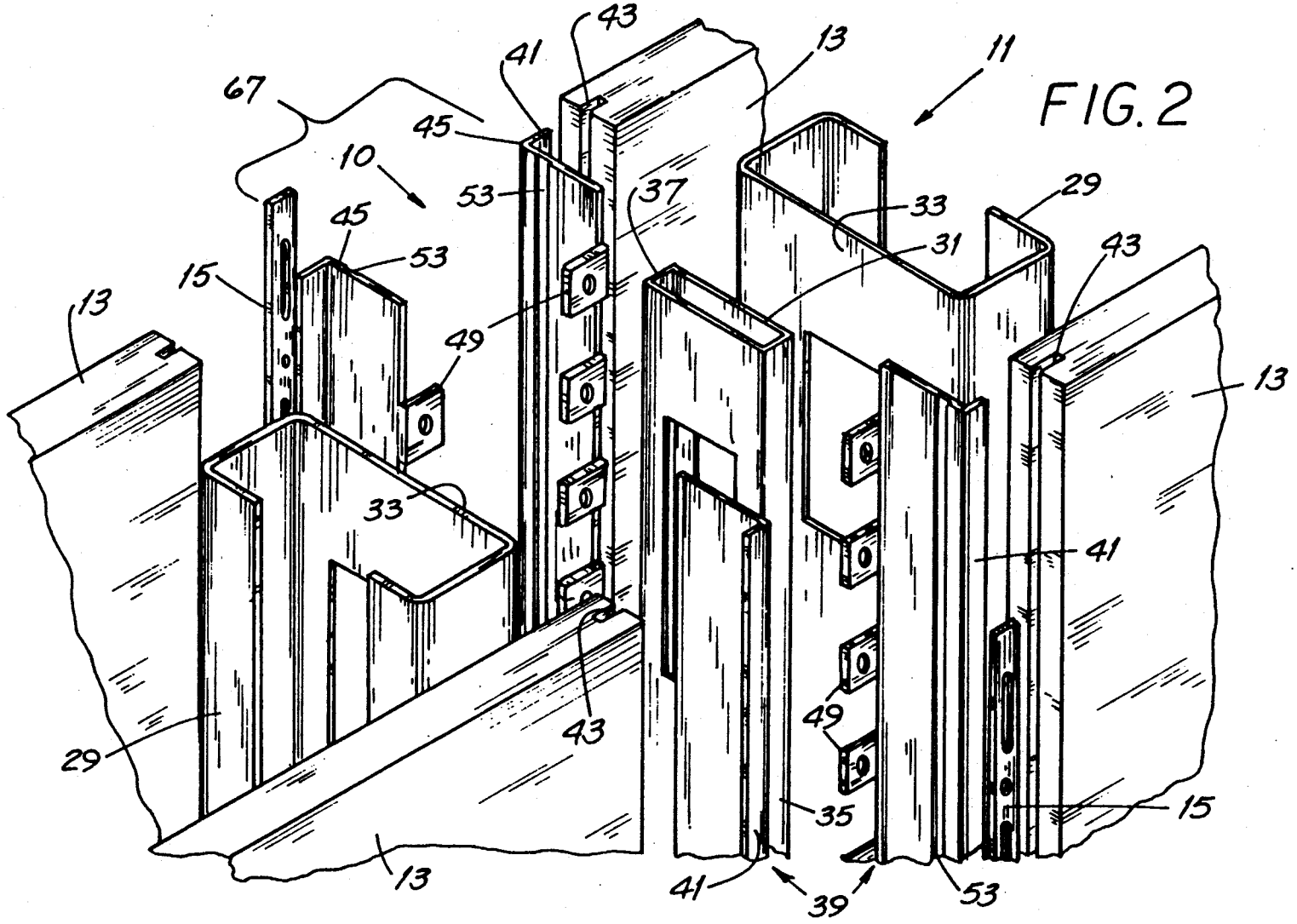
FIG. 2 is an "exploded" perspective view, with parts broken away, showing aspects of the inventive system.
Figure 3:
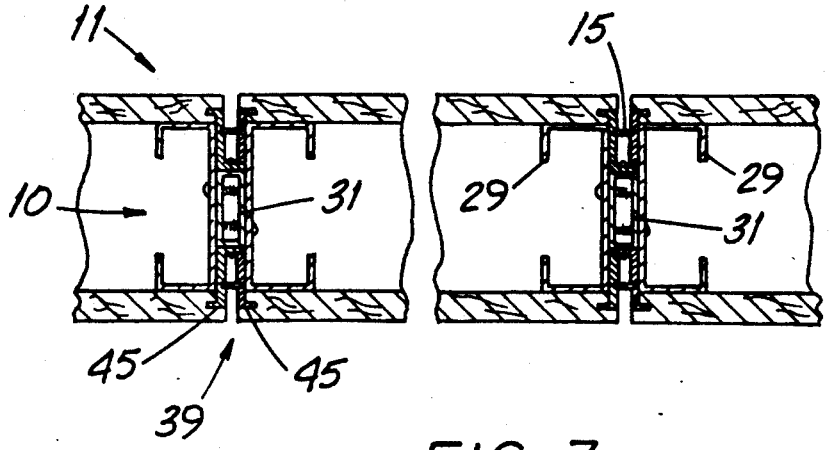
FIG. 3 is a top plan view, partly in section and with parts broken away, of a double-sided display wall incorporating the system of FIG. 2.

Referring next to FIGS. 2 and 3, the improved system 10 will now be described. Such system 10 is shown in connection with a double sided wall 11 but after understanding the specification, one will appreciate how the system 10 is used in a single-sided wall 11, freestanding or floor-to-ceiling.

The system 10 is used for mounting a wall standard 15 in a wall-like display structure of the type having plural support studs 29, e.g., conventional sheet metal studs (as shown) or 2×4's. The improved system 10 includes a box-like "filler" or spacer 31 of rectangular cross-section. The spacer 31 is mounted between the wider faces 33 of adjacent studs 29 so as to separate them slightly. Although the view of FIG. 2 shows various components in spaced-apart locations, in practice the spacer 31 and the studs 29 are in abutting relationship (as are other components) as shown in FIG. 3. The spacer 31 may include a cutout opening for installing electrical wiring or the like in the wall 11.

The spacer 31 has a first attachment edge 35 and, preferably, an oppositely-facing second attachment edge 37. A first retention assembly 39 attaches to the edge 35 and engages and supports one or more wall panels 13 in ways described below. In the arrangement of FIGS. 2 and 3, panel support is by a lip 41 fitted into a groove 43 in the edge of the panel 13. The retention assembly 39 includes a pair of commonly-shaped upright members 45; that is, such upright members 45 are essentially identical to one another.

Figure 4:
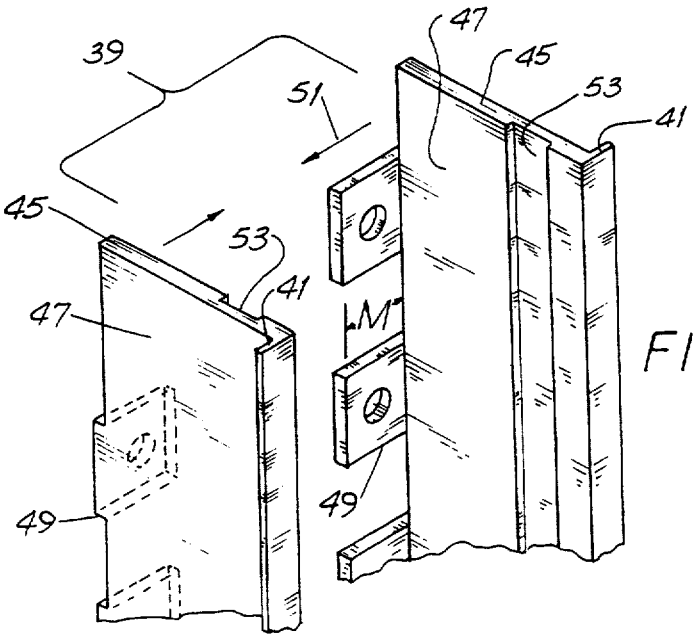
FIG. 4 is a perspective view, with parts broken away and other parts in phantom outline, of a retention assembly used in the system of FIG. 2.

Referring additionally to FIG. 4, each upright member 45 includes a web 47, a plurality of attachment tabs 49 spaced along one edge of the web 47 and a panel retaining lip 41 along its other edge. When mounted in inverted relationship one to the other, each member 45 has at least one tab 49 interposed between a pair of tabs 49 of the other member 45. In fact, virtually all tabs 49 of each member 45 are interposed between tabs 49 of the other in something of an "interdigitated" relationship when the upright members 45 are "fitted" toward one another as suggested by the arrows 51 in FIG. 4. In practice, tabs 49 of a given upright member 45 are spaced on about six inch centers but this dimension is not critical.

Each tab 49 has a width "W" (measured parallel to a floor) closely similar to that of the strip-like standard 15 "captured" between the upright members 45 in a finished wall 11. Selected tabs 49 are attached by sheet metal screws to the edge 35 of the spacer 31 for panel support. The shape of the upright member 45 is such that it lends itself well to fabrication by extrusion and stamping and bending to form the tabs 49.

The webs 47 of those two upright members 45 making up a retention assembly 39 are spaced by about a tab width "W" from that of its companion upright member 45. The tab-to-lip spacing is substantially equal to the width of the web 47. And each such upright member 45 also has a groove 53 for receiving an edge of the standard 15.

Since the standards 15 may bear significant weight, it is preferred that they be solidly retained in the finished wall 11. Such retention is aided by serrating that side of the standard 15 engaging the web 47.

Figure 5:
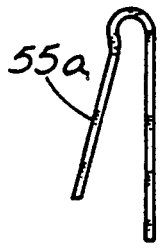
FIG. 5 is a side elevation view of a spring retainer device used with a retention assembly.

Upon initial placement of the standard 15, it is adjustably retained between the grooves 53 by a spring device 55a such as that shown in FIG. 5. Such temporary retention makes it very easy to assure that the display shelves 25, etc. (mounted on the wall 11 at the conclusion of construction) are level. The wall standards 15 can be lightly "tapped" up or down until a reference line drawn through corresponding locations, e.g., the tops of the first slots 17, on the standards 15 is level.

Figure 7:
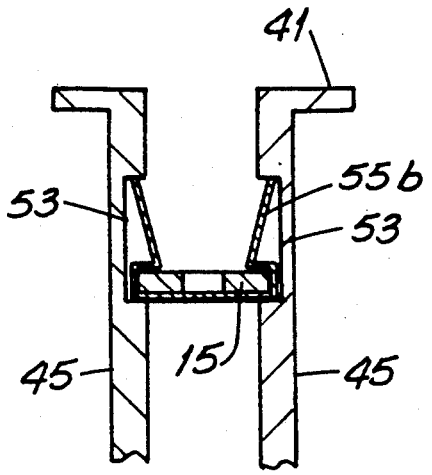
FIG. 7 is a top plan view like that of FIG. 6 and showing another type of spring retainer device.
Figure 8:
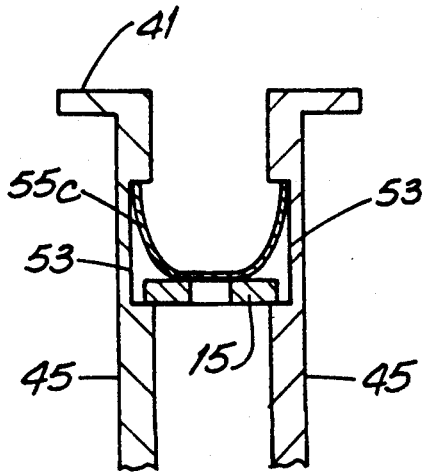
FIG. 8 is a top plan view like that of FIG. 6 showing yet another type of spring retainer device.
Figure 6:
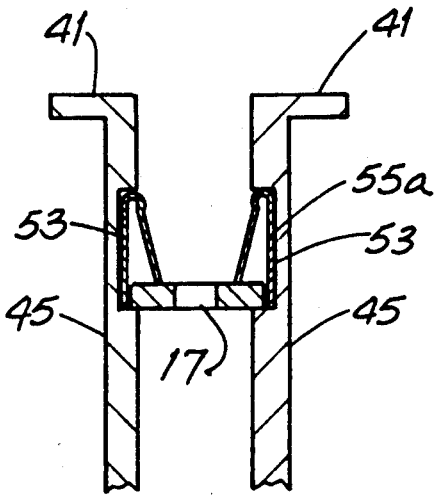
FIG. 6 is a top plan view, in section and with parts broken away, of aspects of the system of FIG. 2 and using a device like that shown in FIG. 5.

As shown in FIG. 6, the spring device 55a may be fitted into the groove 53 of at least one upright member 45 for standard retention. Or as shown in FIG. 7, another type 55*b* of spring device is conformably fitted to (or partially wrapped around) the standard 15. Such device 55*b* engages the grooves 53 of the upright members 45 for temporary standard retention when the standard 15 is inserted between the members 45. Another type of standard-retaining spring device 55*c*, U-shaped, is shown in FIG. 8. After locating the standard(s) 15, a long sheet metal screw is inserted through a few of the several screw holes 57 in the standard 15 and attached to an edge 35 or 37 of the spacer 31.

Figure 10:
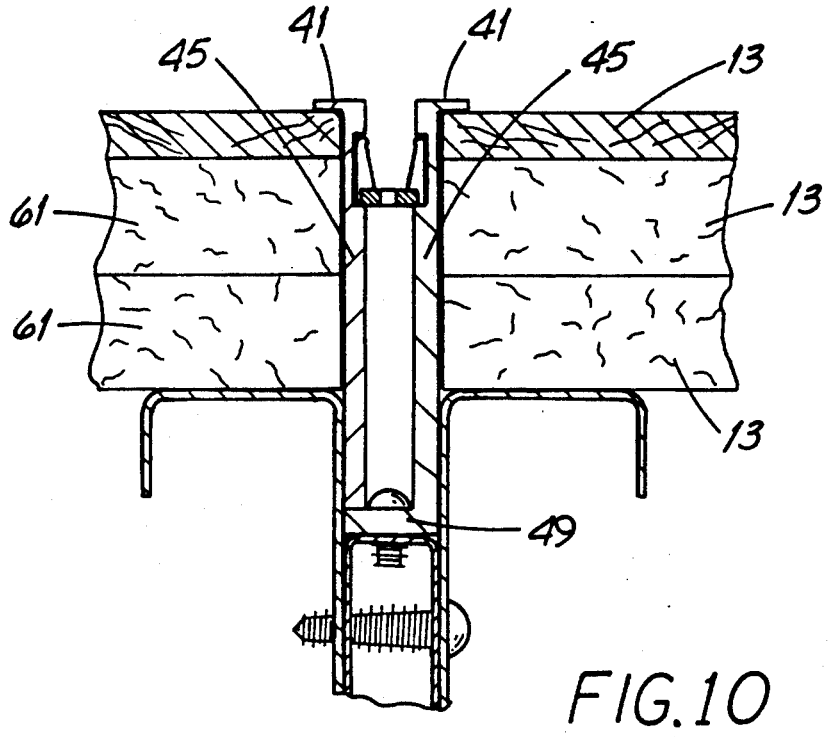
FIG. 10 is a top plan view like that of FIG. 3 and showing another variation of the system of FIG. 2.
Figure 9:
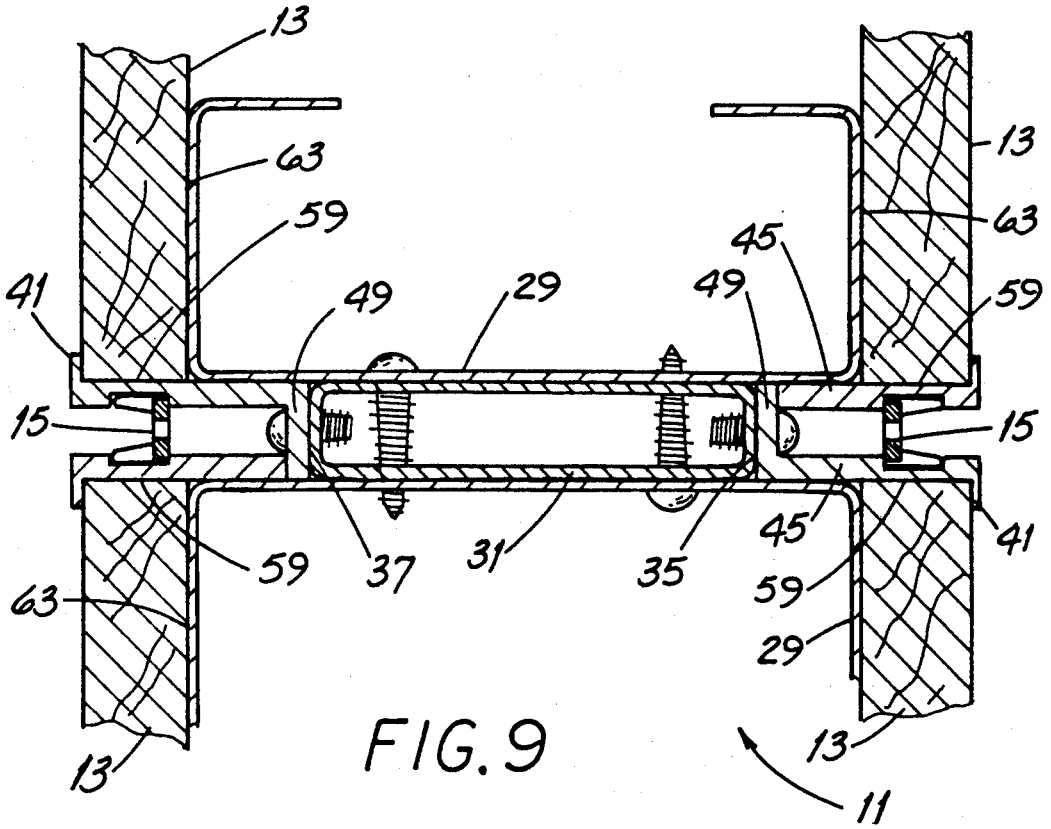
FIG. 9 is a top plan view like that of FIG. 3 and showing a variation of the system of FIG. 2.

Referring next to FIGS. 9 and 10, the new system 10 offers enormous flexibility in constructing perimeter and interior wall standard systems where panels 13 of differing thicknesses may be required to be used. For example, the system 10 may include two or more pairs of upright members 45 , each member 45 of each pair having attachment tabs 49 and a retaining lip 41. A pair of upright members 45, like the members shown in FIG. 9, includes tab-to-lip spacing differing from that of another pair of upright members 45 such as those shown in FIG. 10. The system 10 thereby accommodates panels 13 of differing thicknesses.

In the arrangement of FIG. 9, each side of the wall 11 is "faced" by a single layer of panels 13, the edges 59 of which are slightly spaced apart from one another. The illustrated panels 13 are of the same thickness—but need not be. For example, one side of the wall of FIG. 9 may (as shown in FIG. 10) include two layers 61 of gypsum drywall panel 13 and an outer finish panel 13, the aggregate thickness of such composite panel 13 is being significantly greater than that of the panels 13 in FIG. 9.

Figure 11A:
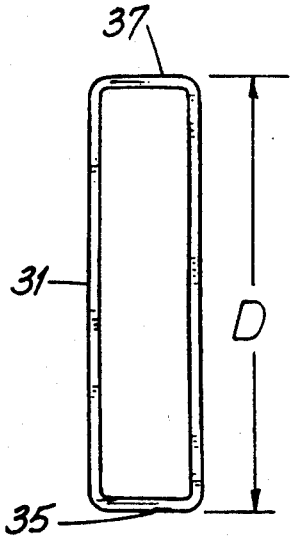
FIGS. 11A, 11B and 11C are top plan view of various sizes of spacers used in the system of FIG. 2.
Figure 11B:
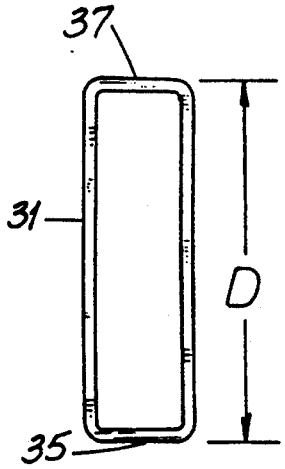
Figure 11C:
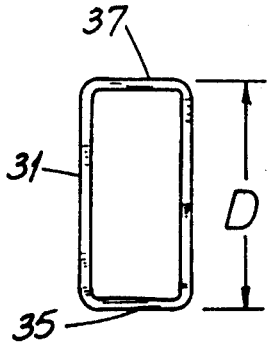

But the new system 10 offers yet more flexibility; the same result may be achieved in other ways. Referring to FIGS. 11A–11C, inclusive, the system 10 may include two or more spacers 31, each having a face dimension "D" differing from that of at least one other spacer 31. This feature also accommodates panels 13 of differing thicknesses. With or without upright members 45 having differing tab-to-lip spacing, a spacer 31 can be "offset," i.e., positioned to have one attachment edge 35 closer to the corresponding stud flange surfaces 63 than the other edge 37 is to its corresponding flange surfaces 63. When so arranged, panels 13 of differing thicknesses can be used even if the tab-to-lip spacing of upright members 45 is the same. Of course, spacers 31 of differing face dimensions "D" and upright members 45 having differing tab-to-lip spacing can be used separately or combined in a single installation. To recap, the installer can accommodate panels 13 of different thicknesses by using (a) spacers 31 of differing face dimensions "D", (b) upright members 45 with differing tab-to-lip spacing and/or (c) offset the position of the spacer 31 with respect to the stud flange surfaces 63.

Figure 12:
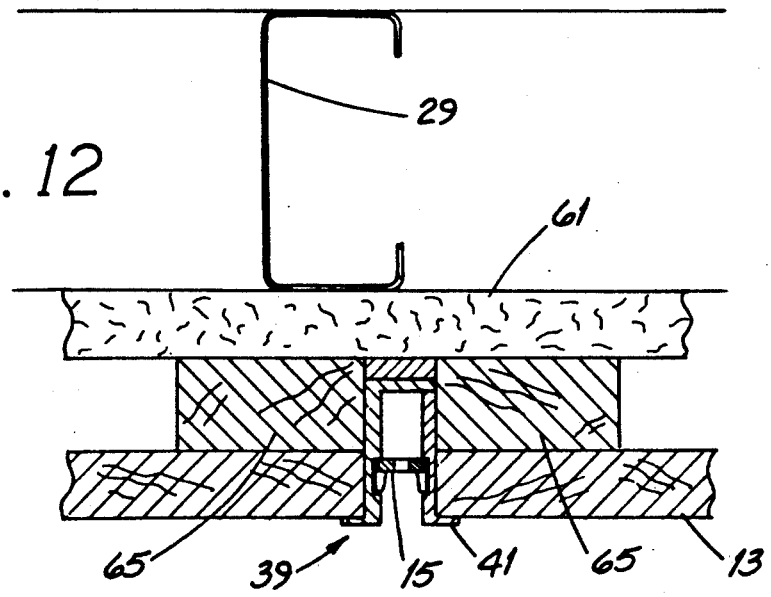
FIG. 12 is a top plan view, partly in section and with parts broken away, illustrating aspects of the system used to make a single-sided display wall.

The improved system 10 lends itself to construction of a perimeter display wall 11, i.e., one mounted to an existing wall.) and of double-sided interior walls 11, whether or not freestanding. FIG. 12 indicates how to construct the former. Wood furring strips 65 are spaced by about the width of a tab 49 and attached to the surface of an existing drywall 61. A retention assembly 39 has a tab-to-lip thickness selected in view of the thickness of the strips 65 and the panels 13 to be mounted. If necessary, thin shims can be placed between the tabs 49 and the drywall 61 to obtain proper spacing between the lip 41 and the strip 65.

A double-sided wall 11 is shown in FIG. 2. Therein, the spacer 31 includes a second attachment edge 37 and a second retention assembly 67 having a pair of upright members 45 attached to the second edge 37 for panel support. It is to be understood that in the arrangements shown in FIGS. 2, 3, 9 and 10, panel retention is by clamping the panel 13 between a lip 41 and that surface 63 immediately behind the panel.

Figure 13:
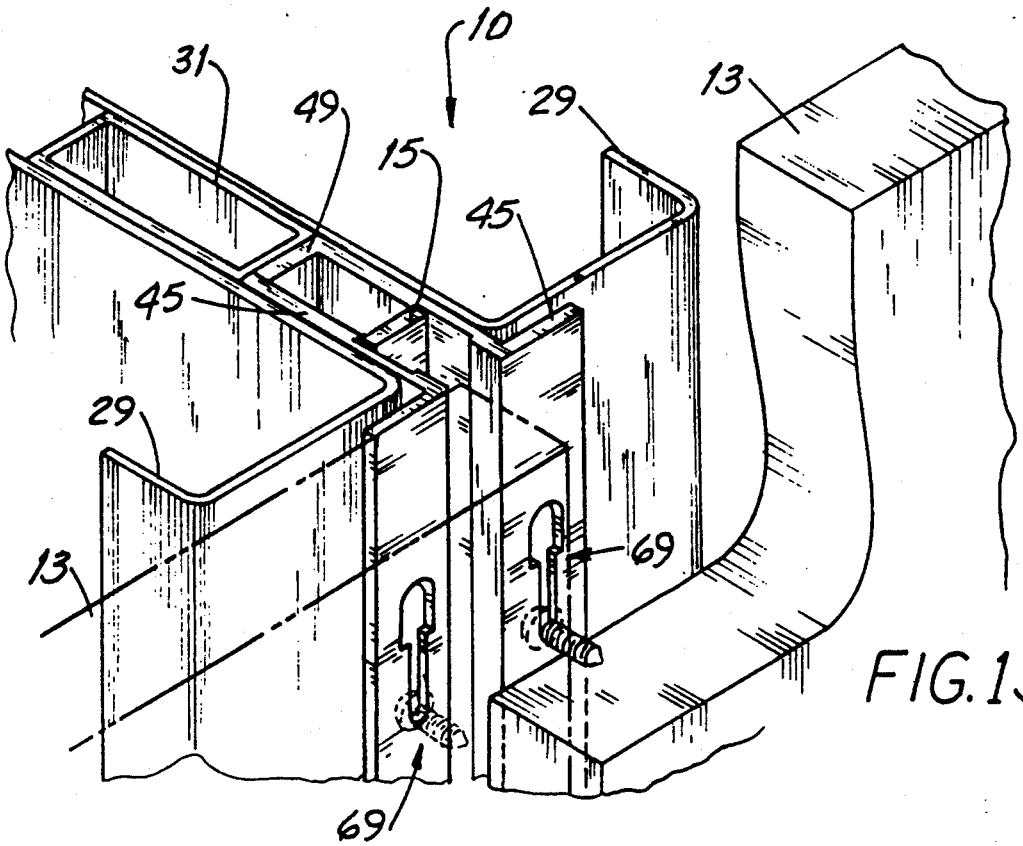
FIG. 13 is a perspective view, partly in phantom and with parts broken away, showing an arrangement having a pin-and-groove panel attachment device useful in conjunction with other aspects of the system.
Figure 14:
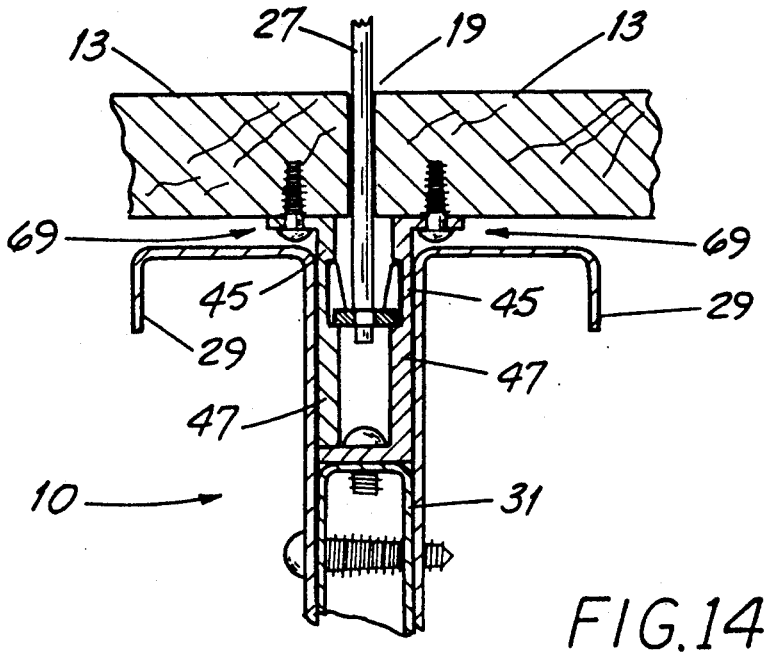
FIG. 14 is a top plan view, partly in section and with parts broken away, of the arrangement of FIG. 13.
Figure 9:
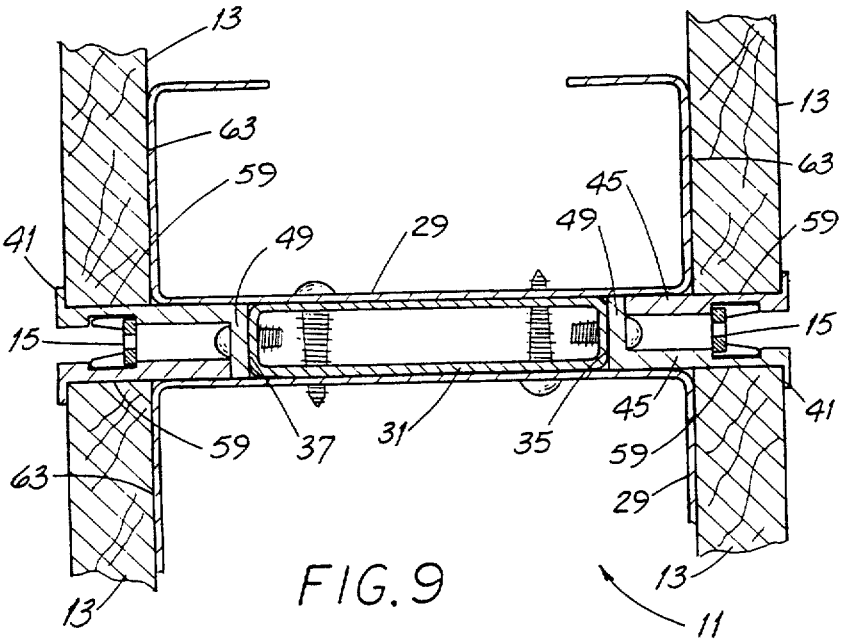

Ease of initial panel mounting and of wall rearrangement or removal are important considerations in wall standard systems. Accordingly, FIGS. 13 and 14 show the system 10 to include panels 13 mounted to upright members 45 (rather than to studs 29) by pin-and-groove devices 69. The upright members 45 support substantial panel weight and the system 10 uses conventional studs 29. With such an arrangement, the gap 19 between panels 13 can be, and preferably is, substantially smaller than the spacing between webs 47. In fact, such gap 19 need be only provide slight clearance for insertion of a bracket 27 or hook. The new system 10 thereby makes the gap 19 as unobtrusive as possible and, consequently, the overall display wall 11 is more attractive.

Figure 15:
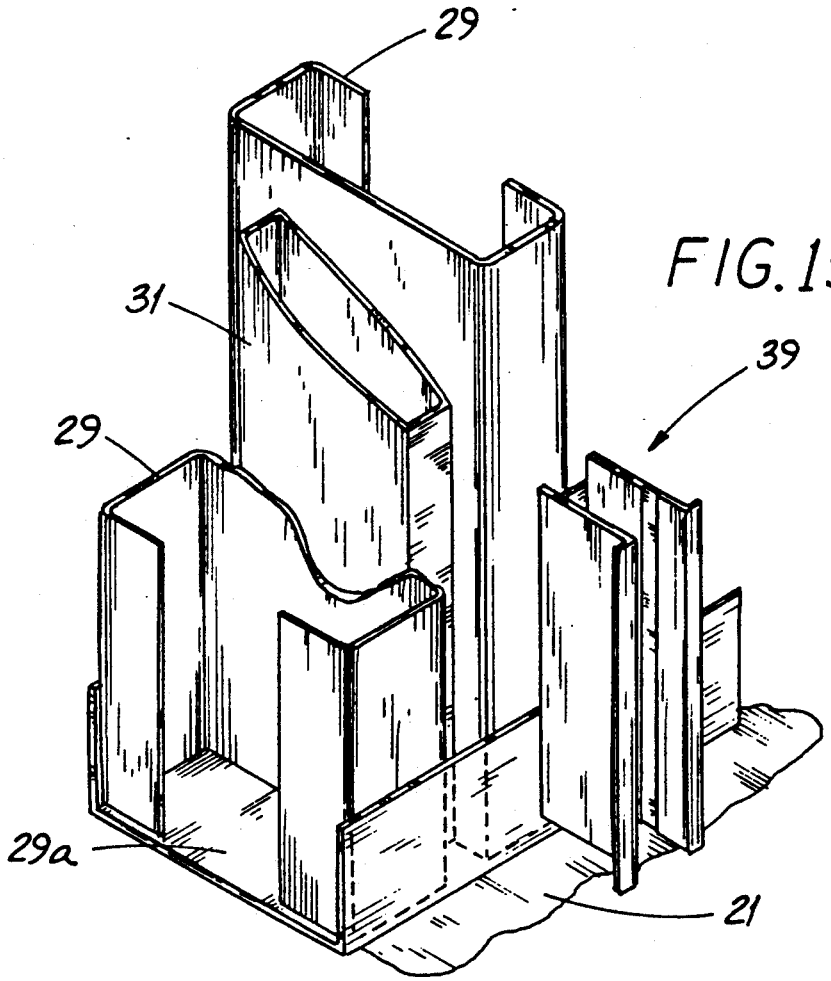
FIG. 15 is an elevation perspective view, partly dashed outline and with parts broken away, illustrating aspects of the system useful to make a freestanding display wall.

FIG. 15 shows how to frame a freestanding wall 11. A "runner" or base stud 29*a* is attached to the floor 21 and vertical studs 29 are attached at either end of the stud 29*a* and at least one intermediate location along the length of such stud 29a. A spacer 31 is between a pair of vertical studs 29 and the retention assembly 39 and other hardware are mounted as described above.

After understanding the specification, one will appreciate how, after onsite measurements are taken, the improved system 10 lends itself to prefabrication offsite, e.g., at the manufacturer's shop. Jigs, fixtures and know-how are available there—and field changes can be made with little trouble.

While the principles of this invention have been described in connection with specific embodiments, it should be understood clearly that these descriptions are made only by way of example and are not intended to limit the scope of the invention.

I claim:

1. In a wall-like display structure of the type supporting wall panels having exterior surfaces, the structure having plural support studs mounted in pairs, wherein each stud has a face and a pair of flange surfaces, the studs of a pair are mounted in face-opposed relationship at a distance from one another and each stud of a pair has a flange surface coplanar with a flange surface of the other stud of the pair, an improved system for mounting a wall standard including:

a spacer mounted between the faces of a pair of studs and having a first attachment edge;

a first retention assembly separate from the spacer and including a pair of commonly-shaped upright members mounted in inverted relationship one to the other and attached to the first attachment edge for panel support;

the retention assembly retaining a slotted standard at a position intermediate the exterior surfaces and the flange surfaces.

2. The system of claim 1 wherein each upright member includes a plurality of spaced attachment tabs, each member having at least one tab interposed between a pair of tabs of the other member.

3. The system of claim 2 wherein each tab has a width and each upright member includes a web spaced by about a tab width from that of the other upright member.

4. The system of claim 1 wherein each upright member has a groove for receiving a strip-like standard adjustably retained between grooves by a spring device for display levelling.

5. The system of claim 4 wherein the spring device is fitted to at least one upright member for standard retention.

6. The system of claim 4 wherein the spring device is fitted to the standard and engages the grooves of the upright members.

7. The system of claim 1 including plural pairs of upright members, each having attachment tabs and a panel retaining lip spaced from such tabs and wherein a pair of upright members includes tab-lip spacing differing from that of another pair of upright members whereby the system accommodates panels of differing thicknesses.

8. The system of claim 7 including plural spacers, each having a face dimension differing from that of at least one other spacer whereby the system accommodates panels of differing thicknesses.

9. The system of claim 1 including plural spacers, each having a face dimension differing from that of at least one other spacer whereby the system accommodates panels of differing thicknesses.

10. The system of claim 9 including plural pairs of upright members, each having attachment tabs and a panel retaining lip spaced from such tabs and wherein a pair of upright members includes tab-lip spacing differing from that of another pair of upright members whereby the system accommodates panels of differing thicknesses.

11. The system of claim 1 including panels mounted to upright members by pin-and-groove devices whereby upright members support substantial panel weight and the system uses conventional studs.

12. The system of claim 1 wherein the spacer includes a second attachment edge and a second retention assembly having a pair of upright members attached to the second edge for panel support in a freestanding interior wall.

13. The system of claim 12 in an interior, double-sided wall having panels on each side and wherein:

each upright member of each retention assembly includes a web having a width; and, the web width of the members of the first assembly differs from that of the members of the second assembly, whereby panels of differing thickness are mounted on the respective wall sides.

14. The system of claim 12 in an interior, double-sided wall having panels on each side and wherein:

each upright member of each retention assembly includes a web having a width;

the widths of such webs are substantially identical one to another;

the studs have flange surfaces; and, the spacer is mounted offset with respect to such flange surfaces, whereby panels of differing thickness are mounted on the respective wall sides.

15. In a wall-like display structure of the type having plural support studs, an improved system for mounting a wall standard including:

a spacer mounted between the studs and having a first attachment edge;

a first retention assembly including a pair of commonly-shaped upright members mounted in inverted relationship one to the other and attached to the first edge for panel support;

each upright member including a plurality of spaced attachment tabs, each member having at least one tab interposed between a pair of tabs of the other member.

16. The system of claim 15 wherein each tab has a width and each upright member includes a web spaced by about a tab width from that of the other upright member.

17. In a wall-like display structure of the type having plural support studs, an improved system for mounting a wall standard including:

a spacer mounted between the studs and having a first attachment edge;

a first retention assembly including a pair of commonly-shaped upright members mounted in inverted relationship one to the other and attached to the first edge for panel support; and wherein the system further includes:

plural pairs of upright members, each having attachment tabs and wherein a pair of upright members includes tap-lip spacing differing from that of another pair of upright members whereby the system accommodates panels of differing thicknesses.

18. The system of claim 17 including plural spacers, each having a face dimension differing from that of at least one other spacer whereby the system accommodates panels of differing thicknesses.

19. In a wall-like display structure of the type having plural support studs, an improved system for mounting a wall standard including:

a spacer mounted between the studs and having a first attachment edge;

a first retention assembly including a pair of commonly-shaped upright members mounted in inverted relationship one to the other and attached to the first edge for panel support; and wherein the system further includes:

plural spacers, each having a face dimension differing from that of at least one other spacer whereby the system accommodates panels of differing thicknesses; and wherein the system further includes:

plural pairs of upright members, each having attachment tabs and a panel retaining lip spaced from the tabs and wherein a pair of upright members includes tab-lip spacing differing from that of another pair of upright members whereby the system accommodates panels of differing thicknesses.

* * * * *

UNITED STATES PATENT AND TRADEMARK OFFICE

CERTIFICATE OF CORRECTION

PATENT NO. : 5,189,850

DATED : March 2, 1993

INVENTOR(S) : J. Reed Felton

It is certified that error appears in the above-identified patent and that said Letters Patent is hereby corrected as shown below:

Sheet 4 of the drawings should be deleted to appear as per attached sheet 4.

UNITED STATES PATENT AND TRADEMARK OFFICE

CERTIFICATE OF CORRECTION

PATENT NO. : 5,189,850

DATED : March 2, 1993

INVENTOR(S) : J. Reed Felton

It is certified that error appears in the above-identified patent and that said Letters Patent is hereby corrected as shown below:

In column 1, line 36, "at any of a number of locations along the standard-" should be at the left margin.

In column 2, line 64, delete "a" and insert --as--.

In column 5, line 39, after "partly" insert --in--.

In column 5, line 51, delete "standards" and insert --"standards"--.

In column 5, line 63, delete "as shown in dashed outline".

In column 10, line 31, "and wherein the system further includes:" should be at the left margin.

In column 10, line 34 after "and" insert --a panel retaining lip spaced from the tabs and---.

In column 10, line 35, delete "tap-lip" and insert --tab-lip--.

In column 10, line 50, "and wherein the system further includes:" should be at the left margin.

Signed and Sealed this

Thirtieth Day of November, 1993

Bruce Lehman

*Attest:*

BRUCE LEHMAN

*Attesting Officer*

*Commissioner of Patents and Trademarks*